US005803714A

United States Patent [19]

Tominaga et al.

[11] Patent Number: 5,803,714

[45] Date of Patent: Sep. 8, 1998

[54] SWASH PLATE TYPE AXIAL PISTON PUMP AND METHOD OF ASSEMBLING THE SAME

[75] Inventors: Tsutomu Tominaga; Kazuyoshi Yamamoto; Daisuke Ochi; Yoshihiko Onishi, all of Tokyo, Japan

[73] Assignee: Mitsubishi Denki Kabushiki Kaisha, Tokyo, Japan

[21] Appl. No.: 626,550

[22] Filed: Apr. 2, 1996

[30] Foreign Application Priority Data

Oct. 24, 1995 [JP] Japan ..... 7-275886

[51] Int. Cl.[6] ..... F04B 1/12; F04B 1/26

[52] U.S. Cl. ..... 417/269; 417/270

[58] Field of Search ..... 417/269, 270

[56] References Cited

U.S. PATENT DOCUMENTS

| | | | |
|---|---|---|---|
| Re. 25,750 | 3/1965 | Stewart | 417/270 |
| 5,000,667 | 3/1991 | Taguchi et al. | 417/270 |

FOREIGN PATENT DOCUMENTS

| | | | |
|---|---|---|---|
| 240524 | 9/1962 | Australia | 417/270 |
| 730439 | 12/1961 | Canada | 417/270 |
| 1 453 423 | 7/1962 | Germany . | |
| 1453423 | 3/1969 | Germany | 417/269 |
| 39 01 064 | 7/1989 | Germany . | |
| 3901064 | 7/1989 | Germany | 417/269 |
| 57-20574 | 2/1982 | Japan . | |

*Primary Examiner*—Bibhu Mohanty

*Attorney, Agent, or Firm*—Sughrue, Mion, Zinn, Macpeak & Seas, PLLC

[57] ABSTRACT

A swash plate type axial piston pump of enhanced assemblability and high assembling efficiency, in which looseness between constituent members of the pump is suppressed to minimum. A valve plate (31) and a cylinder block (15) are inserted in a first housing section (1*a*) sequentially, and then a second housing section (1*b*) is installed on the cylinder block (15) around an outer periphery and fixedly secured to the first housing section (1*a*), wherein an annular resilient member (29), an annular supporting member (24) and an annular shoe holder (27) are inserted in the second housing section (1*b*) sequentially. A plurality of pistons (21) each having a shoe (25) connected pivotally at one end are inserted into the cylinders (13), respectively, of the cylinder block (15) through retaining holes (27*a*), respectively, formed in the annular shoe holder (27). A swash plate (23) is inserted into the second housing section (1*b*) such that one lateral surface thereof bears against the shoes (25) with an outer peripheral portion of the swash plate (23) bearing against an end surface of the annular supporting member (24). A third housing section (1*c*) supporting the rotatable shaft (3) is attached to the second housing section (1*b*) and then a bracket (8) incorporating an input shaft (11) and a magnetic coupling (9) is attached to the third housing section (1*c*).

6 Claims, 5 Drawing Sheets

SWASH PLATE TYPE AXIAL PISTON PUMP AND METHOD OF ASSEMBLING THE SAME

BACKGROUND OF THE INVENTION

1. Field of the Invention

The present invention generally relates to a swash plate type axial piston pump (also known as the cam plate type axial piston pump) or swash plate pump). More particularly, the invention is concerned with a swash plate type axial piston pump of a novel and improved structure which can be assembled very easily in a much facilitated manner while ensuring an enhanced vibration withstanding capability.

2. Description of Related Art

For having better understanding of the invention, background techniques thereof will first be elucidated in some detail. FIG. 6 is a vertical sectional view showing a conventional swash plate type axial piston pump known heretofore. Referring to the figure, disposed within a housing 101 generally of a cup-like configuration is a rotatable shaft 103 having one end portion which is rotatably supported at a bottom of the housing 101 by means of a needle bearing 107. The other end portion of the rotatable shaft 103 is rotatably supported in a bracket 102 secured to an open end of the housing 101 by means of a ball bearing 105. A pulley 108 is fixedly mounted on an externally projecting portion of the rotatable shaft 103 and operatively coupled to a driving source (not shown) such as an internal combustion engine by means of a transmission member such as a belt. Disposed in the bracket 102 at the outer side of the ball bearing 105 is an annular oil seal 112 which serves for isolating fluid-tightly the interior of the housing 101 from the exterior.

Formed in the rotatable shaft 103 is a spline 113 onto which a cylinder block 111 having a plurality of cylinders 109 is mounted axially slideably and rotatably together with the rotatable shaft 103. The plural cylinders 109 of the cylinder block 111 are so formed as to be disposed around the rotatable shaft 103 with approximately equal angular distance between the adjacent cylinders 109, wherein pistons 115 are slideably accommodated within the cylinders 109, respectively, so as to be reciprocatively movable in the axial direction of the swash plate pump. An annular swash plate (inclined plate) 117 is mounted on the rotatable shaft 103 with a play, wherein a sliding plate 118 is disposed or accommodated within a recess formed in an inner surface of the swash plate 117 in such an arrangement that one ends of the pistons 115 are caused to bear against or contact the sliding plate 118 through interposed shoes 119, respectively. A portion of the outer periphery of the swash plate 117 is resiliently biased by a resiliently urging member 120 in the axial direction toward the left-hand side as viewed in FIG. 6 while a diametrically opposite peripheral portion of the swash plate 117 bears against a stopper 122 mounted within the housing 101 with the outer lateral surface of the swash plate 117 being brought into contact with the inner surface of the housing 101 under pressure. In this manner, the swash plate 117 is secured to the housing 101.

The individual shoes 119 of the pistons 115 are retained by an annular shoe holder 123 so as to bear against the sliding plate 118 disposed within the recess formed in the swash plate 117. More specifically, the annular shoe holder 123 is formed within a plurality of retaining holes 123*a* corresponding to the pistons 115, respectively, wherein each of the retaining holes 123*a* receives therein the associated shoe 119 in such a manner that the inner surface of the retaining hole 123*a* is placed in contact with a shoulder portion of the shoe 119, while an outer peripheral portion of the shoe holder 123 bears against a ring-like retainer 125 mounted on the outer peripheral portion of the sliding plate 118 by means of screws 124. In this manner, the individual shoes 119 are held slideably relative to the swash plate 117 through cooperation of the retainers 125 and the shoe holders 123.

Further formed in each of the shoes 119 is a semispherical recess 119*a* in which a semispherical head 115*a* of the corresponding piston 115 is rotatably received. In this way, the semispherical heads 115*a* of the pistons 115 are pivotally or swingably mounted in the shoes 119, respectively.

Interposed between the bottom surface of the cylinder block 111 and the inner surface of the housing 101 is a valve plate 129 which is prevented from rotation by means of pins 131. The valve plate 129 is formed with an intake port and an exhaust port (both not shown). The cylinder block 111 is resiliently urged to the right, as shown in FIG. 6, by means of a coil spring 135 mounted on and around the rotatable shaft 103, whereby the bottom of the cylinder block 111 is resiliently forced to bear against the inner surface of the housing 101 under the action of the coil spring 135 through the valve plate 129 interposed therebetween. Defined in each of the cylinders 109 of the cylinder block 111 is a pump chamber 110 which is selectively communicated to an intake or suction passage or a discharge passage (both not shown) formed in the housing 101 by way of the intake or discharge port of the valve plate 129.

With the structure of the swash plate type axial piston pump described above, the rotatable shaft 103 is driven rotationally by the driving source such as an engine of a motor vehicle (rot shown) by way of the pulley 108. Then, the cylinder block 111 is caused to rotate together with the rotatable shaft 103, whereby the pistons 115 accommodated within the respective cylinders 109 are caused to revolve together with the shafts 103. Because one ends of the pistons 115 bear against the swash plate 117 through the respective shoes 119, which plate 117 is inclined relative to the axial direction of the rotatable shaft 103, the pistons 115 are forced to move reciprocatively within the cylinders 109 in accompanying the rotation of the shaft 103. Thus, during the intake or suction stroke in which the piston 115 is moved to the left, as viewed in FIG. 6, a fluid such as oil is sucked into the pump chamber 110 formed in the cylinder 109 via the intake port (not shown) of the valve plate 129 through an intake passage (not shown either) formed in the housing 101 and leading to an external oil reservoir (not shown either), while during the discharge stroke in which the piston 115 is moved to the right as viewed in FIG. 6, the working oil confined within the pump chamber 110 is pressurized, as a result of which the oil is discharged to the discharge passage (not shown) formed in the housing 101 by way of the discharge port (not shown either) of the valve plate 129.

The swash plate type axial piston pump described above is assembled in such a manner as described below. In the first place, the semispherical heads 115*a* of the pistons 115 are fit in the semispherical recesses 119*a* of the shoes 119, respectively. Subsequently, the shoes 119 are fit into the retaining holes 123*a*, respectively, which are formed in the shoe holder 123. Thereafter, the shoe holder 123 is fixedly secured to the outer peripheral portion of the swash plate 117 by means of the screws 124 in the state in which one ends of the shoes 119 are previously placed in contact with the sliding plate 118 accommodated within the recess formed in the swash plate 117. Subsequently, the individual pistons 115 of the subassembly composed of the pistons 115 and the swash plate 117 thus assembled are inserted into the corresponding cylinders 109, respectively, formed in the cylinder block 111 to thereby attach fixedly the above-mentioned subassembly to the cylinder block 111. Thus, a subassembly constituted by the pistons 115, the swash plate 117 and the cylinder block 111 is completed.

Subsequently, the ball bearing 105 and the oil seal 112 are mounted within the bracket 102, while one end portion of the rotatable shaft 103 is supported on the bracket 102 by means of the ball bearing 105. The subassembly of the bracket 102 and the rotatable shaft 103 thus formed is then combined with the previously mentioned subassembly of the piston 115, the swash plate 117 and the cylinder block 111. More specifically, the rotatable shaft 103 is inserted through the swash or cam plate and the shoe holder to mount the cylinder block 111 on the spline 113. Then, the top end of the rotatable shaft 103 of the subassembly thus formed is inserted through the housing 101 into the needle bearing 107 which has previously been mounted on the bottom of the housing 101. In this conjunction, it should be mentioned that the valve plate 129 is previously mounted on the bottom inner surface of the housing 101 with the stopper 122 and the resilient bias member 120 having been mounted within the housing 101 beforehand.

Finally, the bracket 102 and the housing 101 are fixedly secured to each other by using bolts or the like (not shown), and the pulley 108 is mounted on the rotatable shaft 103 at the exposed end portion. Additionally, a hydraulic circuit element such as a regulator for adjusting the pump pressure is installed on the bottom of the housing 101.

As is apparent from the above, in assembling the swash plate type axial piston pump, the pistons 115 are inserted into the cylinders 109, respectively, formed in the cylinder block 111 after having mounted the subassembly of the shoe holder 123 and the piston 115 on the swash plate 117. Consequently, troublesome procedure is required for inserting into the cylinders 109 the pistons 115 which are apt to vary their positions relative to the respective shoes 119. Thus, the swash plate type axial piston pump known heretofore is disadvantageous in that the assemblability thereof is poor, giving rise to degradation in the efficiency for assembling or manufacturing the pump.

Furthermore, the hydraulic circuit component such as a regulator (not shown) of a relatively heavy structure has to be mounted on the bottom portion of the housing 101 which is secured to the bracket 102. In other words, the hydraulic circuit component such as the regulator and the like is disposed at a position distanced considerably from a location at which the bracket 102 is mounted to a main body of a motor vehicle, which means that the bracket 102 is subjected to relatively large stress due to application of a moment of large magnitude, giving rise to a problem in respect to the mechanical strength of the bracket 102 and hence the vibration withstanding capability thereof and hence that of the pump as a whole.

SUMMARY OF THE INVENTION

In the light of the state of the art described above, it is an object of the present invention to provide a swash plate type axial piston pump which is significantly improved in respect to the assemblability and which can thus ensure a high efficiency in assembling or manufacturing the pump.

Another object of the present invention is to provide a swash plate type axial piston pump in which looseness existing between elements or members constituting the pump and inter alia looseness between the swash plate and the supporting member is essentially eliminated, while those members which are caused to move slidingly relative to each other such as the supporting member and the shoe holder or the shoes and the swash plate are protected against an excessively large pressing force or pressure to thereby ensure smooth and silent operation of the swash plate type axial piston pump over an extended period or use life.

It is yet another object of the present invention to provide a swash plate type axial piston pump which is improved in respect to the vibration withstanding capability an hence the durability by adopting such a structure which prevents moment or stress of large magnitude from being applied to the bracket on which the swash plate type axial piston pump is mounted.

In view of the above and other objects which will become apparent as the description proceeds, there is provided according to a general aspect of the present invention a swash plate type axial piston pump which includes a first housing section provided with an intake passage which can be connected to an external oil reservoir and a discharge passage capable of discharging a pressurized oil to the exterior, wherein the first housing section has one end opened. A second hollow housing section is connected at one end thereof to the open end of the first housing section. A third housing section is attached to the other end of the second housing section. A rotatable shaft is disposed within a housing formed by the first housing section, the second housing section and the third housing section and has one end supported rotatably in the first housing section by means of a first bearing and the other end rotatably supported in the third housing section by means of a second bearing. A cylinder block is disposed within the first and second housing sections and so mounted on the rotatable shaft as to slide in an axial direction thereof and corotate therewith. Further, the cylinder block has a plurality of cylinders each of which defines therein a pump chamber. A valve plate has one end surface bearing against an inner surface of the first housing section and the other end surface bearing slideably on a bottom surface of the cylinder block. The valve plate has an intake port and a discharge port for allowing the intake passage and the discharge passage formed in the first housing section to be selectively communicated to the pump chamber defined within each of the cylinders. The rotatable shaft rotatably extends through the valve plate. An annular supporting member is disposed within the second housing section. An annular shoe holder has a plurality of retaining holes and is slideably held at an outer peripheral portion thereof by means of the supporting member. A plurality of pistons each having one end portion slideably are fit into the cylinders, respectively, while shoes are pivotally coupled to the other ends of the pistons, respectively, and are retained by the retaining holes, respectively, of the annular show holder. A swash plate is installed within the second housing section and has an outer peripheral portion bearing against the annular supporting member in a state in which the swash plate is inclined relative to a center axis of the rotatable shaft. The swash plate is capable of slideably bearing against the shoes. The rotatable shaft extends rotatably through the swash plate.

In a preferred mode for carrying out the invention, the swash plate type axial piston pump mentioned above may further be so arranged as to include an insulator which is disposed between the second housing section and the third housing section and has one lateral surface bearing against the swash plate for holding the swash plate at the outer peripheral portion thereof in cooperation with the annular supporting member. The rotatable shaft is rotatably inserted through the insulator.

In another preferred mode for carrying out the invention, the annular supporting member may be so arranged as to include an annular recess formed in one end surface thereof and an annular offset portion formed at a position distanced from the annular recess in the axial direction. The outer peripheral portion of the swash plate engages with the annular recess of the annular supporting member, while the outer peripheral portion of the annular shoe holder slideably bears against the annular offset portion of the annular supporting member. A resiliently urging member for urging the annular supporting member to bear on the swash plate may be disposed within the second housing section at one side of the annular supporting member.

In yet another preferred mode for carrying out the invention, the swash plate type axial piston pump may further be provided with a bracket attached to other end of the third housing section for supporting rotatably by means of a bearing an input shaft coupled to the rotatable shaft through a magnetic coupling.

In a further preferred mode for carrying out the invention, the swash plate type axial piston pump may be so arranged as to include a regulator which is provided in association with the second housing section for adjusting a discharge oil pressure within the discharge passage to be constant.

In yet further preferred mode for carrying out the invention, the swash plate type axial piston pump may be comprised of a two-way valve provided in association with the second housing section for changing over flow paths for working oil discharged from the discharge passage.

According to another aspect of the present invention, there is provided a method of assembling a swash plate type axial piston pump, which method includes the steps of inserting in a first housing section having a first bearing attached thereto from an opened end thereof a valve plate having an intake port and a discharge port and a cylinder block having a plurality of cylinders defining pump chambers, respectively, sequentially in this order, installing a second housing section on the cylinder block around an outer periphery thereof and fixedly securing one end surface of the second housing section to an opened end of the first housing section, inserting in the second housing section an annular resilient bias member, an annular supporting member and an annular shoe holder having a plurality of retaining holes sequentially in this order, inserting a plurality of pistons each having a shoe connected pivotally at an end thereof into each of the cylinders of the cylinder block through the retaining holes, respectively, formed in the annular shoe holder, inserting an annular swash plate into the second housing section such that one lateral surface of the swash plate bears against the shoes, with an outer peripheral portion of the swash plate bearing against an end surface of the annular supporting member, and inserting a rotatable shaft having an end portion supported rotatably on a third housing section by a second bearing from the other end portion into the first bearing mounted in the first housing section through the swash plate, the annular shoe holder, the annular supporting member, the resiliently urging member, the cylinder block and the valve plate, and then attaching fixedly the third housing section to the second housing section.

In a preferred mode for carrying out the method mentioned above, an annular insulator may be mounted on an end surface of the second housing section, before attaching the third housing section supporting the rotatable shaft.

In another preferred mode for carrying out the method described above, there may be provided the steps of supporting an input shaft rotatably by means of a bearing and attaching to the third housing section a bracket incorporating a magnetic coupling for operatively coupling the input shaft to the rotatable shaft.

In yet another preferred mode for carrying out the method described above, there may further be provided a step of attaching to the second housing section a regulator for adjusting an oil discharge pressure within the discharge passage so as to be constant.

For carrying out the method described above, there may additionally be provided a step of attaching to the second housing section a two-way valve for changing over flow paths for working oil discharged from the discharge passage.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
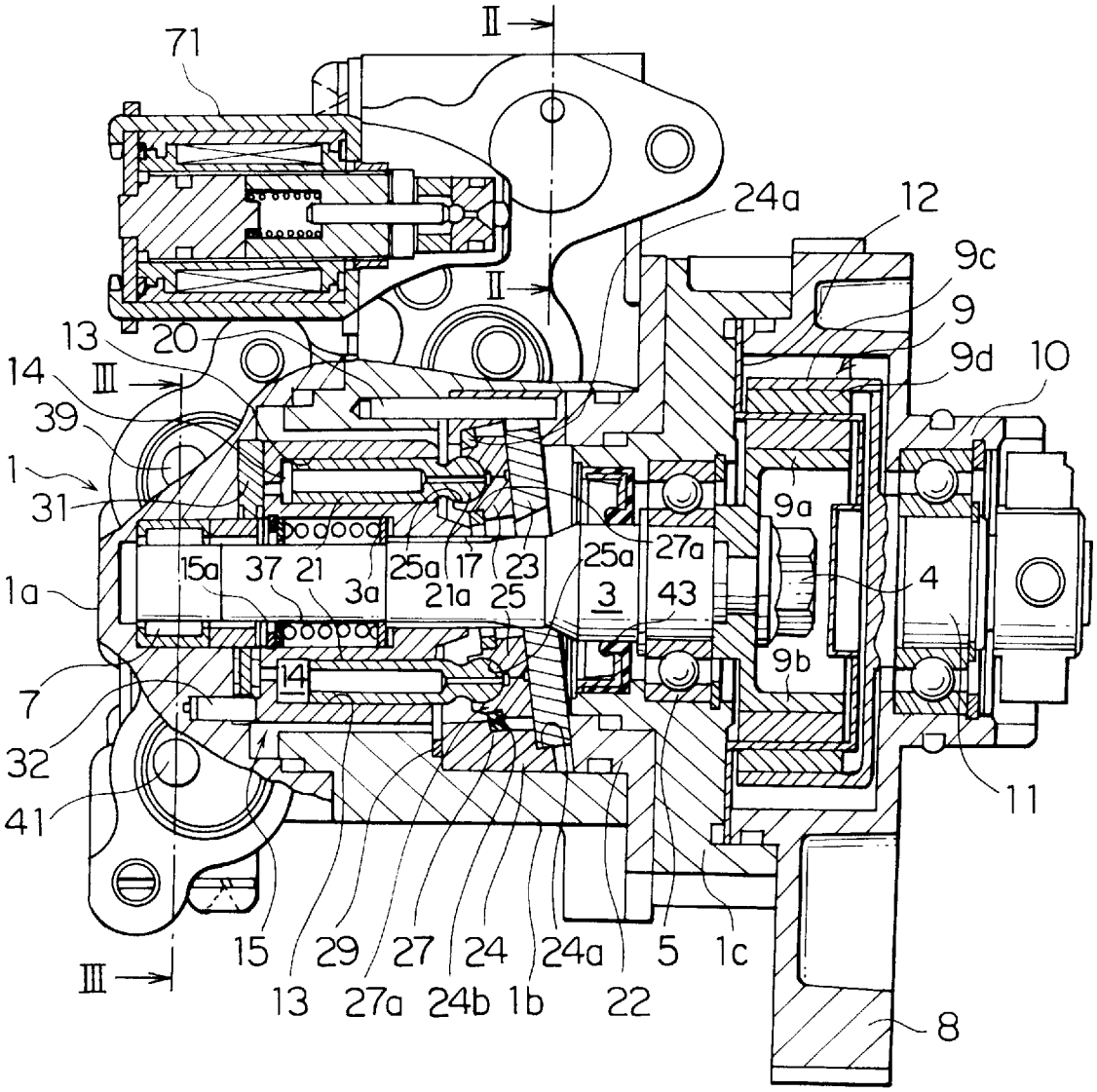
FIG. 1 is a vertical sectional view showing a swash plate type axial piston pump according to a first embodiment of the present invention.
Figure 2:
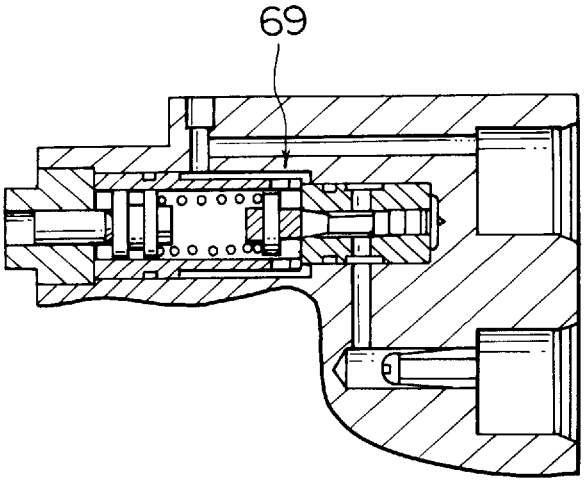
FIG. 2 is a sectional view of the same taken along a line II—II shown in FIG. 1.

Now, the present invention will be described in detail in conjunction with what is presently considered as preferred or typical embodiments thereof by reference to the drawings. In the following description, like reference characters designate like or corresponding parts throughout the several views. Also in the following description, it is to be understood that such terms as "left", "right", "top", "bottom", "upwardly", "downwardly" and the like are words of convenience and are not to be construed as limiting terms.

Embodiment 1

FIG. 1 is a vertical sectional view showing a swash plate type axial piston pump according to a first embodiment of the present invention.

Referring to the figure, a housing 1 formed generally in a cylinder-like shape and having one end opened right end portion, as viewed in the figure and the other end closed to form a bottom (left end portion) is comprised of a first housing section 1*a* forming the closed end portion of the housing 1, a second housing section 1*b* forming a main body portion of the housing 1 and a third housing section 1*c* forming the opened end portion thereof.

Accommodated within the housing 1 is a rotatable shaft 3 which is rotatably supported in the housing 1 by a second bearing such as a ball bearing 5 or the like at the one end portion (right end portion as viewed in the figure) and a first bearing such as a needle bearing 7 or the like at the other end portion (left end portion). A bracket 8 for supporting the swash plate pump is fixedly secured to the open end portion of the housing 1, wherein an input shaft 11 is rotatably supported on the bracket 8 by means of a ball bearing 10 or the like. The input shaft 11 has one end operatively coupled to the right end portion of the rotatable shaft 3 by way of a magnetic coupling 9 accommodated in the bracket 8 and the other end portion (right end portion) which is operatively coupled to a driving source such as an internal combustion Engine or the like of a motor vehicle (both not shown).

The magnetic coupling 9 is comprised of an inner magnet 9*b* mounted on an outer periphery of an annular inner yoke 9*a* which is secured to the rotatable shaft 3 by means of a nut 4 and an outer magnet 9*d* mounted on an inner periphery of an outer yoke 9*c* which is secured to the input shaft 11 coaxially therewith at the outer side of the inner yoke 9*a*, wherein the inner magnet 9*b* and the outer magnet 9*d* are coaxially disposed with an annular air-gap defined therebetween. Disposed within the annular air-gap defined between the inner and outer magnets 9*b* and 9*d* is a partition wall member 12 of a hat-like shape which serves for hermetically sealing the interior of the third housing section 1*c* from the exterior and which has a collar secured fixedly between the third housing section 1*c* and the bracket 8 in a sandwiched manner. By virtue of the structure described above, rotation or torque of the input shaft 11 can be transmitted to the( rotatable shaft 3 through the magnetic coupling constituted by the inner and outer magnets 9*b* and 9*d*.

The rotatable shaft 3 has a splined shaft portion 17 formed therein, wherein a cylinder block 15 incorporating a plurality of cylinders 13 formed in a coaxial circular array is fit onto the splined shaft portion 17 slideably in the axial direction and corotatably with the shaft 3. The cylinders 13 formed in the cylinder block 15 are disposed around the rotatable shaft 3 with substantially equidistance therebetween, wherein a piston 21 is disposed within each of the cylinders 13 sliding in the axial direction.

Further, a ring-like or annular swash plate 23 is mounted on the rotatable shaft 3 with a play, wherein the swash plate 23 is fixedly held by the housing 1 along the outer peripheral portion in a state inclined or slanted relative to the center axis of the rotatable shaft 3. More specifically, the outer peripheral portion of the swash plate 23 is snugly fit into an annular recess 24*a* formed in one end surface (right end surface) of an annular supporting member 24 and fixedly held therein, being sandwiched between the annular supporting member 24 and an annular insulator 22 formed of a heat insulation material and disposed in opposite to the supporting member 24 with the swash plate 23 interposed therebetween. The end surface of the annular supporting member 24 which bears against the swash plate 23 is inclined or slanted relative to the center axis of the rotatable shaft 3. Similarly, the supporting surface of the insulator 22 which bears on the swash plate 23 is disposed with an inclination relative to the center axis of the rotatable shaft 3 and secured fixedly between the second housing section 1*b* and the third housing section 1*c* in the inclined state. A pin 20 is so mounted as to extend through the outer peripheral portions of the swash plate 23 and the annular supporting member 24, respectively, wherein one end portion (left end portion) of the pin 20 is inserted into the second housing section 1*b* with the other end portion thereof being inserted into the insulator 22 so as to prevent the swash plate 23 and the supporting member 24 from revolving relative to the housing 1. Additionally, the pin 20 serves for positioning the swash plate 23 and the supporting member 24.

The pistons 21 are adapted to bear on an inner or left lateral surface of the swash plate 23 at one or right end thereof by way of shoes 25, respectively. More specifically, an approximately semispherical head 21*a* formed at one end of each of the pistons 21 is rotatably fit into a semispherical recess 25*a* formed in the corresponding shoe 25, whereby each piston 21 is swingably or pivotally coupled to the associated shoe 25. A portion of each shoe 25 is held slideably in contact with the one or inner lateral surface of the swash plate 23 through cooperation of an annular shoe holder 27 and the annular or ring-like supporting member 24. The annular shoe holder 27 is formed with a number of retaining holes 27*a* corresponding to that of the shoes 25, respectively, wherein the shoes 25 are fit into the retaining holes 27*a*, respectively, while the outer peripheral portion of the shoe holder 27 bears against an offset portion 24*b* formed in the inner peripheral surface of the annular supporting member 24. Thus, when the pistons 21 are revolved together with the cylinder block 15 as the shaft 3 is rotated, the shoes 25 and the shoe holders 27 are caused to rotate around the rotating shaft 3 together with the cylinder block 15, whereby the end surfaces of the individual shoes 25 are caused to move slideably relative to the swash plate 23 in the state contacting with the latter, while the annular shoe holder 27 is caused to move slideably relative to the offset portion 24*b* of the annular supporting member 24.

Furthermore, the annular supporting member 24 is resiliently urged to the right, as viewed in FIG. 1, by a resilient bias member such as a wave washer 29 which bears against the other or left or left lateral surface of the supporting member 24 as a result of which the opposite or right lateral surface of the annular supporting member 24 is resiliently pressed against the swash plate 23 which in turn is pressed against the inclined supporting surface of the insulator 22, while the shoes 25 are pressed onto the swash plate 23 through the medium of the annular supporting member 24 and the shoe holder 27. In this manner, looseness between the annular supporting member 24 and the swash plate 23 as well as looseness between the swash plate 23 and the supporting surface of the insulator 22 can be eliminated. Besides, because a predetermined distance is provided between the surface of the swash plate 23 bearing against the annular supporting member 24 and the shoe holder 27, excessively high contact pressure is prevented from acting between the shoe holder 27 and the annular supporting member 24 sliding relative to each other as well as between the shoes 25 and the swash plate 23 also sliding relative to each other. Thus, smooth sliding can be realized between these slideable members.

Interposed between the bottom side (left-hand side) of the cylinder block 15 and the inner surface of the first housing section la constituting the closed end portion of the housing 1 is an annular valve plate 31 which is fixedly secured by means of a pin 32 against angular displacement relative to the first housing section 1*a*. As can clearly be seen from FIG. 4, an intake port 31*a* and a discharge port 31*b*, each of an arcuate shape, are formed in the valve plate 31. Mounted around an outer peripheral surface of the rotatable shaft 3 is a coil spring 37 which has one end retained by a spring retainer 3*a* secured to the rotatable shaft 3 at one end of the splined portion 17 and the other end retained by a spring retainer 15*a* provided at the inner peripheral surface of the cylinder block 15. Thus, the cylinder block 15 is resiliently urged to the left, as viewed in FIG. 1, under the influence of the coil spring 37, whereby the bottom of the cylinder block 15 is pressed against the inner surface of the housing 1 by way of the interposed valve plate 31.

Figure 3:
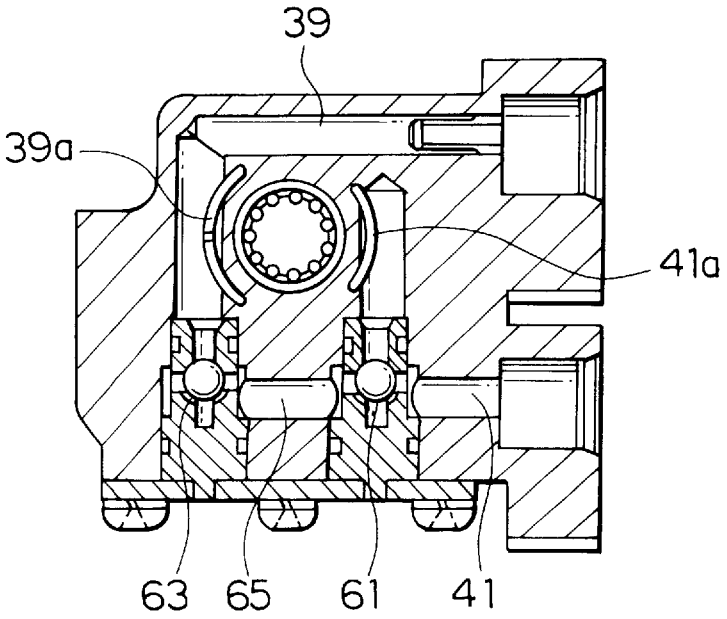
FIG. 3 is a sectional view of the same taken along a line III—III shown in FIG. 1.

The first housing section 1*a* is provided with an intake passage 39 connected to an external oil reservoir 53 (refer to FIG. 3) for sucking a working oil and a discharge passage 41 for discharging the oil to an external hydraulic device such as fuel injectors 51*a* (refer to FIG. 5), wherein the intake passage 39 and the discharge passage 41 are communicated to arcuate interconnecting passages 39*a* and 41*a*, respectively, which are formed in the first housing section 1*a* and opened in the inner surface thereof (refer to FIG. 3).

The pump chamber 14 defined in each of the cylinders 13 formed in the cylinder block 15 is adapted to be selectively communicated to the arcuate interconnecting passage 39*a* or 41*a* formed in the first housing section 1*a* by way of the intake port 31*a* or a discharge port 31*b* of the valve plate 31, as the cylinder block 15 rotates in accompanying the rotation of the shaft 3.

Provided on the inner peripheral surface of the third housing section 1*c* at the open end side of the housing 1 is an annular oil seal 43 which is positioned at the inner side of the ball bearing 5 (at the left side, as viewed in FIG. 1) for sealing fluid-tightly the interior of the housing 1 from the exterior, wherein the inner peripheral surface of the oil seal 43 is placed in close contact with the outer peripheral surface of the rotatable shaft 3.

Provided in association with the second housing section 1*b* constituting a part of the housing 1 are a regulator 69 and an electromagnetic change-over valve 71 serving as a two-way valve for controlling a hydraulic pressure and a flow of the working oil in a hydraulic circuit in which the swash plate type axial piston pump is destined to be installed. Since the second housing section 1*b* is disposed closer to the bracket 8 when compared with the first housing section 1*a* constituting the closed end portion of the housing 1, the regulator 69 and the electromagnetic changeover valve 71 are disposed at respective positions which are located closer to the bracket 8.

Figure 5:
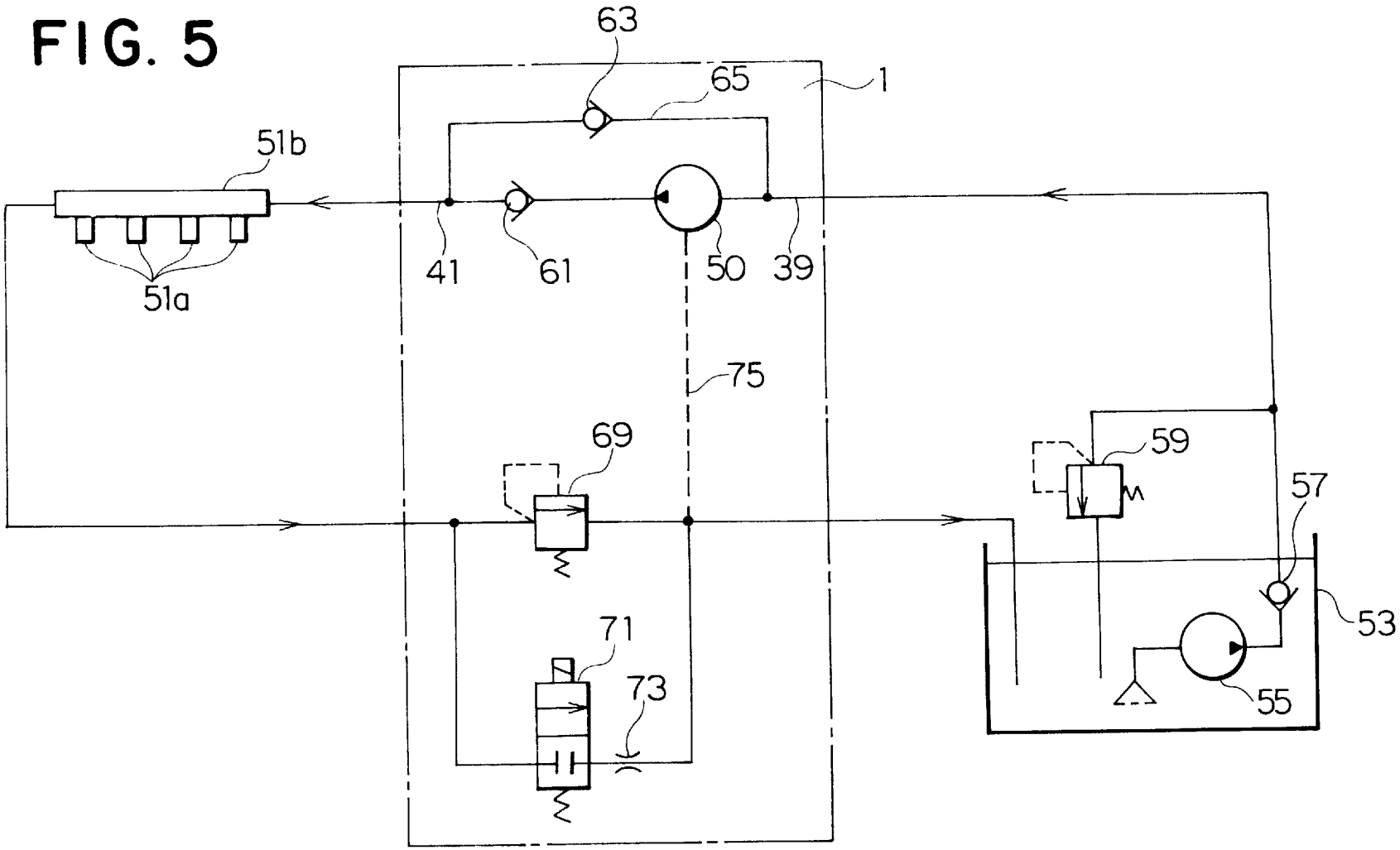
FIG. 5 is a circuit diagram showing a configuration of a hydraulic circuit in which the swash plate type axial piston pump shown in FIG. 1 is employed in a fuel supplying circuit incorporating an injector for an internal combustion engine of a motor vehicle.
Figure 6:
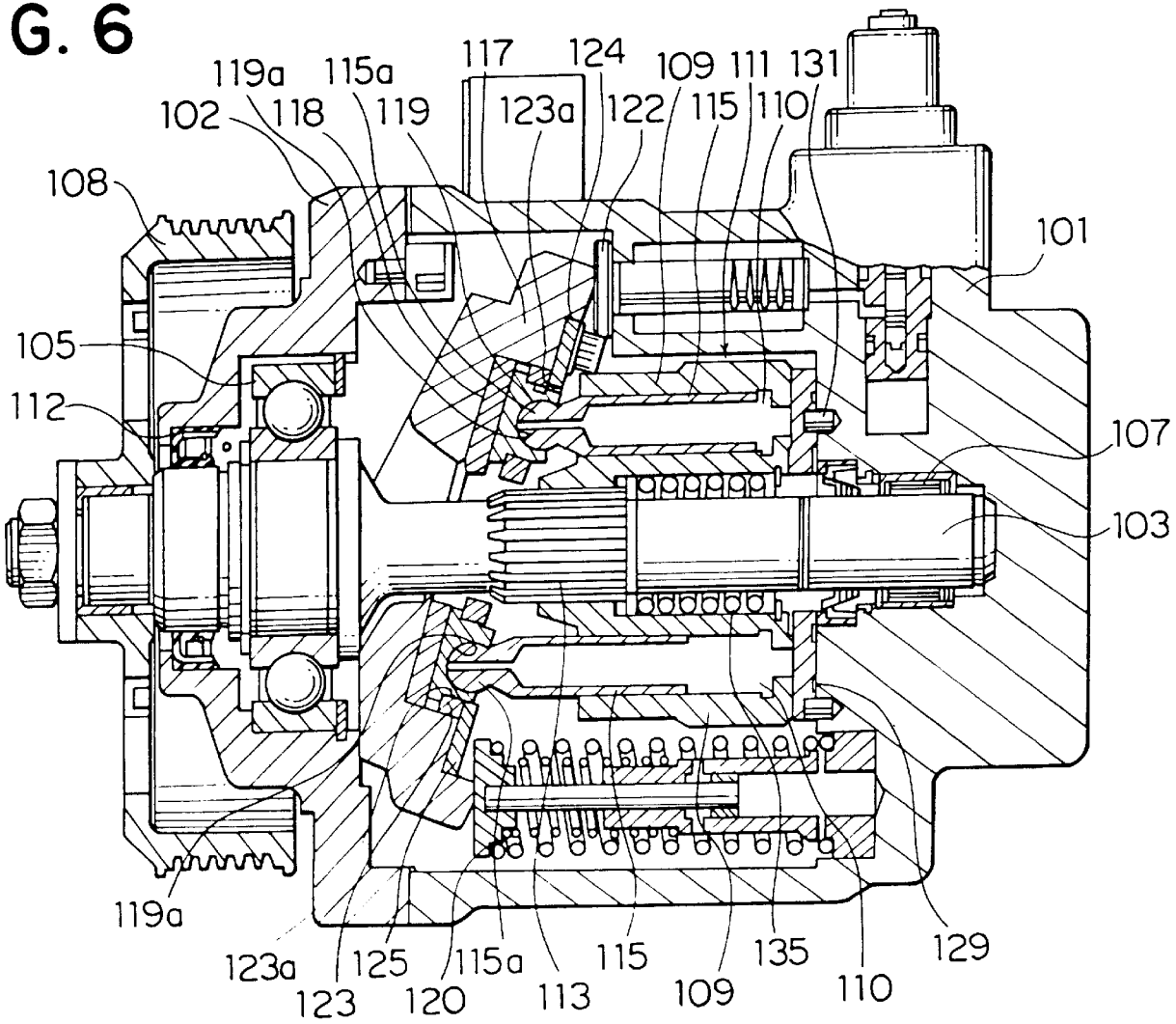
PRIOR ART FIG. 6
FIG. 6 is a vertical sectional view showing a conventional swash plate type axial piston pump known heretofore.

FIG. 5 is a circuit diagram showing a hydraulic circuit in which the swash plate type axial piston pump according to the instant embodiment of the invention is employed as a high-pressure pump 50 for supplying a fuel to fuel injectors 51*a* of an internal combustion engine of a motor vehicle. Referring to the figure, the discharge passage 41 of the high-pressure pump 50 is connected to an inlet port of a distributing pipe 51*b*, while the intake passage 39 of the high-pressure pump 50 is connected to a low-pressure pump 55 by way of a check valve 57, wherein the low-pressure pump 55 is disposed within the oil reservoir 53 such as a fuel tank or the like. The discharge port of the low-pressure pump 55 is connected to the oil reservoir 53 by way of a low pressure, regulator 59 at a position downstream of the check valve 57 which functions to admit the flow of the working oil only in the direction from the low-pressure pump 55 toward the high-pressure pump 50 while preventing the flow in the reverse direction. Installed in the discharge passage 41 of the high-pressure pump 50 is a check valve 61, wherein the discharge passage 41 is communicated to the intake passage 39 by way of a bypass oil passage 65 having a bypass valve 63 installed therein at a position downstream of the check valve 61. The check valve 61 installed in the discharge passage 41 allows the working oil to flow from the high-pressure pump 50 to the distributing pipe 51*b* while preventing the flow in the reverse direction. Similarly, the bypass valve 63 installed in the bypass oil passage 65 allows the working oil to flow only in the direction from the intake passage 39 to the discharge passage 41 while preventing the oil flow in the reverse direction.

Further, the discharge port of the distributing pipe 51*b* is hydraulically connected to the oil reservoir 53 by way of a parallel connection of the regulator 69 and the electromagnetic change-over valve 71 disposed within the housing 1 of the high-pressure pump 50. An orifice 73 is interposed between the electromagnetic change-over valve 71 and a junction of the regulator 69 and the electromagnetic change-over valve 71. The high-pressure pump 50 is communicated to the junction of the regulator 69 and the electromagnetic change-over valve 71 by way of a drain passage (or pipe) 75 formed in the housing 1.

Figure 4:
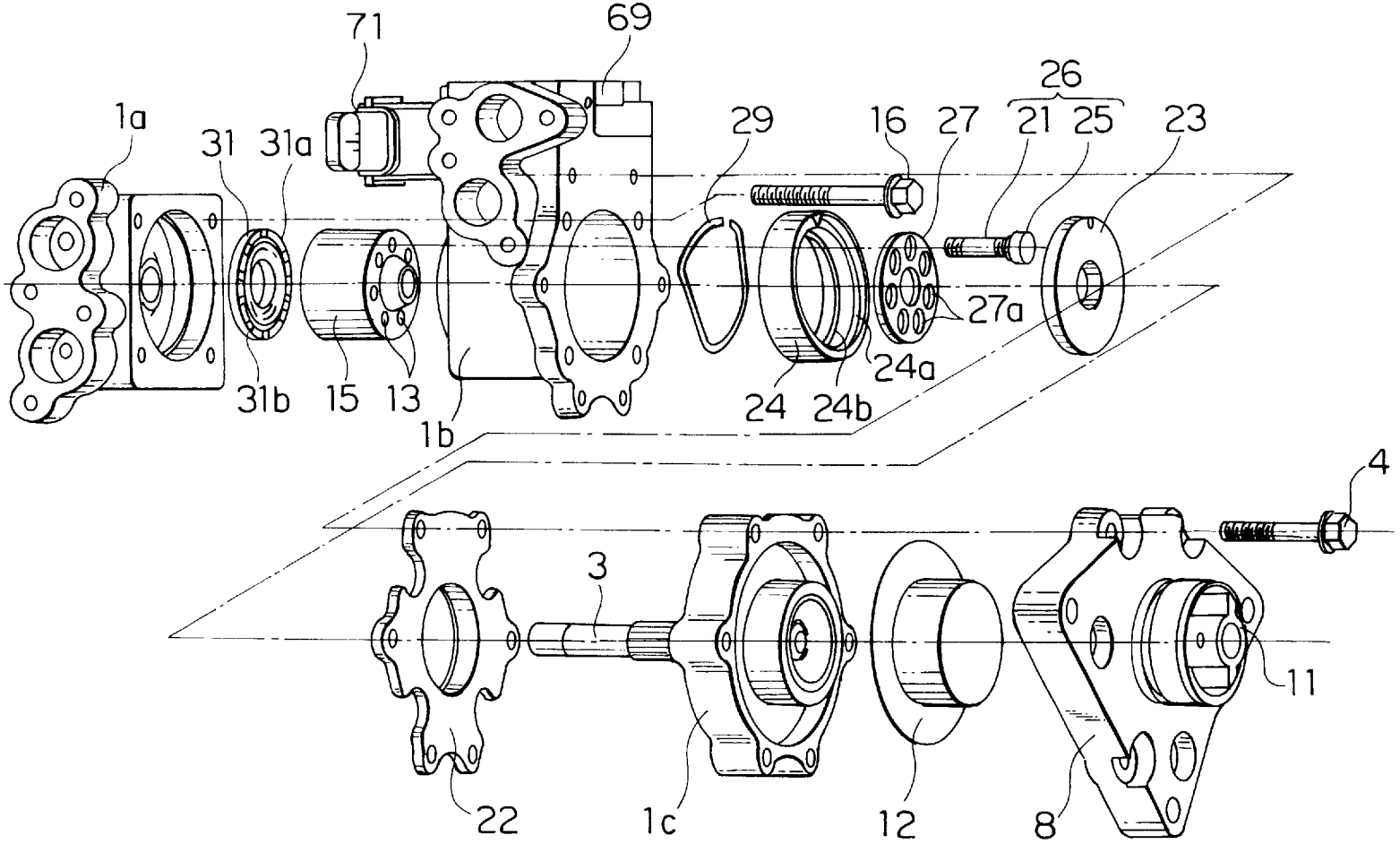
FIG. 4 is an exploded perspective view for illustrating a method of assembling the swash plate type axial piston pump shown in FIG. 1.

Next, referring to FIG. 4, description will be directed to a method of assembling the swash plate type axial piston pump of the structure described above.

As is shown in FIG. 4, the valve plate 31 and the cylinder block 15 are inserted into the first housing section 1*a* constituting the bottom portion (closed end portion) of the housing 1 sequentially in this order. Subsequently, the second housing section 1*b* constituting a main body part of the housing 1 is installed around the outer periphery of the cylinder block 15, whereupon one or inner lateral surface of the second housing section 1*b* is so positioned as to bear against the opposite surface of the first housing section 1*a*. Thereafter, the first housing section 1*a* and the second housing section 1*b* are clamped together by using a plurality of bolts 16. Thereafter, the wave washer 29 and the annular supporting member 24 are sequentially inserted into the second housing section 1*b*, and then the shoe holder 27 is fit into the annular supporting member 24 so as to bear on the annular offset portion 24*b*. Subsequently, a subassembly 26 of the pistons 21 and the shoes 25 assembled previously is attached by inserting the individual pistons 21 into the corresponding cylinders 13, respectively, formed in the cylinder block 15 through the retaining holes 27*a* of the shoe holder 27. In succession, the swash plate 23 is fit into the annular recess 24*a* formed in an outer end surface of the annular supporting member 24, whereupon the insulator 22 is disposed on the coupling surface formed at the other or right end of the second housing section 1*b*. Now, the third housing section 1*c* having the rotatable shaft 3, the annular oil seal 43, the ball bearing 5, the inner yoke 9*a* and the inner magnet 9*b* installed therein previously is attached. Then, the hat-like partition wall 12 is disposed at the outer lateral surface of the third housing section 1*c*, which is then followed by attachment of the bracket 8 having the outer yoke 9*c*, the outer magnet 9*d*, the ball bearing 10 and the input shaft 11 previously installed therein to the third housing section 1*c*, whereupon the bracket 8 is secured to the third housing section 1*c* by clamping a plurality of nuts 4.

By preparing previously the subassembly of the piston 21 and the shoe 25, that of the rotatable shaft 3 and the third housing section 1*c*, that of the input shaft 11 and the bracket 8 and others, and attaching these subassemblies sequentially in the order described above, the swash plate type axial piston pump can be assembled or manufactured extremely easily and with high efficiency. Furthermore, because there is no necessity of mounting previously a plurality of pistons swingably to the swash plate by means of the annular retainer with the shoes and the shoe holder being interposed and then attaching this subassembly to the cylinder block or because there is no need for inserting simultaneously a plurality of pistons held swingably on the swash plate into a corresponding number of cylinders, respectively, differing from the conventional swash plate type axial piston pump, but the subassemblies each constituted by the piston 21 and the shoe 25 can be inserted one-by-one into the corresponding retaining holes 27*a* of the shoe holder 27 and the cylinders 13 of the cylinder block sequentially. Thus, the efficiency of assembling or manufacturing the swash plate type axial piston pump can significantly be enhanced.

Next, operation of the swash plate type axial piston pump installed in a hydraulic circuit will be described by reference to FIGS. 1 and 5. At first, the driving source such as an internal combustion engine (not shown) is activated to drive the rotatable shaft 3 by way of the input shaft 11 and the magnetic coupling 9. Then, the cylinder block 15 is caused to corotate with the rotatable shaft 3, which results in that the pistons 21 accommodated within the respective cylinders 13 are revolved together with the cylinder block 15. Because the pistons 21 have respective ends bearing against the swash plate 23 which is fixedly supported by the housing 1 in the state inclined relative to the center axis of the rotating shaft 3, the pistons 21 are caused to move reciprocatively in the axial direction of the shaft 3 within the respective cylinders 13 as the pistons 21 revolve around the rotating shaft 3.

The fuel such gasoline discharged from the low-pressure pump 55 disposed within the oil reservoir 53 is supplied to the intake passage 39 formed in the housing 1 by way of the check valve 57. However, at a time point immediately after the engine has been started, the intake pressure of the high-pressure pump 50 driven by the engine is low. Consequently, the fuel within the intake passage 39 flows to the discharge passage 41 through the bypass oil passage 65 and the check valve 61 to be supplied to the distributing pipe 51*b*, as a result of which fractions of the fuel are fed to the individual engine cylinders with the remaining part of the fuel flowing to the regulator 69 and the electromagnetic change-over valve 71 installed within the housing 1. Because the electromagnetic change-over valve 71 is opened immediately after the start of the engine, the fuel flowing through the electromagnetic change-over valve 71 is so regulated as to flow at a constant flow rate under the restricting action of the orifice 73 to be fed back to the oil reservoir 53.

As the rotation speed (rpm) of the engine increases, the suction effort of the high-pressure pump 50 increases. Thus, during the intake stroke of the engine in which the pistons 21 are caused to move to the right as viewed in FIG. 1, the pump chambers 14 defined by the cylinders 13, respectively, are placed into communication with the intake port 31*a* formed in the valve plate 31, sequentially, as the cylinder block 15 rotates, whereby the fuel supplied to the intake passage 39 from the low-pressure pump 55 is sucked into the pump chamber 14 defined by the cylinder 13 from the intake passage 39 via the intake port 31*a* of the valve plate 31. During the discharge stroke in which the piston 21 is caused to move to the left as viewed in FIG. 1, the pump chamber 14 is communicated to the discharge port 31*b* formed in the valve plate 31, as a result of which the fuel resident within the pump chamber 14 is pressurized to be discharged into the discharge passage 41 via the discharge port 31*b* and thence fed to the distributing pipe 51*b* by way of the check valve 61. Then, a part of the fuel is fed to the engine cylinders through the fuel injectors 51*a* while the remaining part of the fuel is forced to flow to the regulator 69 and the electromagnetic changeover valve 71 installed within the housing 1.

When the engine operation becomes stable upon lapse of a predetermined time after the start of the engine, the electromagnetic change-over valve 71 is changed over to the closed state. Consequently, the discharge pressure of the high-pressure pump 50 increases gradually. When it exceeds a predetermined value (determined by a spring force of the regulator 69), the regulator 69 assumes an open or communicating state, whereby the fuel is fed back to the oil reservoir 53 via the regulator 69. On the other hand, when the discharge pressure of the high-pressure pump 50 becomes lower than the predetermined value, the regulator 69 is set to the closed state to thereby interrupt communication between the discharge port of the high-pressure pump 50 and the oil reservoir 53, which involves increasing of the discharge pressure of the high-pressure pump 50. In this way, the discharge pressure of the high-pressure pump 50 is maintained substantially constant.

At this juncture, it should be mentioned that so long as the discharge pressure of the low-pressure pump 55 is lower than a preset value of the low-pressure regulator 59, the latter remains in the closed state, while when the discharge pressure increases beyond the preset value, the low-pressure regulator 59 is changed over to the open state to thereby allow the discharge port of the low-pressure pump 55 to communicate with the oil reservoir 53. Thus, the discharge pressure of the low-pressure pump 55 is maintained to be substantially constant.

The fuel resident within the housing 1 is fed back to the oil reservoir 53 by way of the drain passage (or pipe) 75.

Modifications

In the case of the swash plate type axial piston pump described above, one end of the rotatable shaft 3 is coupled to the input shaft 11 by means of the magnetic coupling 9. As a modification, a pulley may be mounted on the rotatable shaft 3 at one end thereof with the pulley being operatively coupled to a driving source such as the engine by using a power transmission member such as a belt or the like. In that case, the magnetic coupling 9 and the input shaft 11 as well as the bracket 8 may be spared. Alternatively, the bracket 8 may be implemented integrally with the third housing section 1*c*. Of course, the third housing section 1*c* may be replaced by the bracket 8.

In the illustrated structure of the swash plate type axial piston pump, the insulator 22 is interposed between the third horsing section 1*c* and the second housing section 1*b* for intercepting heat conduction from the bracket 8 and the third housing section 1*c* to the second housing section 1*b*. However, the insulator 22 may be replaced by a member having a same shape as the insulator 22 and formed of material having high thermal conductivity such as aluminum or the like. Alternatively, one end portion of the third housing section 1*c* may be formed in a shape similar to that of the insulator 22.

As is apparent from the foregoing description, the swash plate type axial piston pump can be assembled very easily in a much simplified manner by attaching the constituents or components of the pump sequentially in the order mentioned previously. Thus, assemblability as well as manufacturing efficiency of the swash plate type axial piston pump can significantly be improved.

Furthermore, looseness between the annular supporting member 24 and the swash plate 23 as well as between the swash plate 23 and housing 1 can be eliminated by pressing the annular supporting member 24 against the swash plate 23 by means of a resiliently urging member such as the wave washer 29 while holding the shoe 25 and the annular shoe holder with an appropriate clearance therebetween by the annular supporting member 24 and the swash plate 23. Thus, the swash plate type axial piston pump can be operated silently without generating noise. Additionally, because clearance can properly be provided between the annular shoe holder 27 and the annular supporting member 24 and between the shoe 25 and the swash plate 23, there can be realized smooth relative sliding movements between the members mentioned above, respectively, whereby frictional abrasion thereof can be mitigated, which contributes to enhancement of the durability or elongation of the use life of the swash plate type axial piston pump.

Besides, because the regulator 69 and the electromagnetic change-over valve 71 are provided in association with the second housing section 1*b* constituting a part of the housing 1, it is possible to dispose the regulator 69 and the electromagnetic change-over valve (two-way valve) 71 at a position closer to the bracket 8 than the first housing section 1*a* constituting the closed end portion of the housing 1. Thus, when compared with the conventional pump structure in which the elements mentioned above are provided at the closed end portion of the housing remote from the bracket 8, the moment applied to the bracket 8 can be decreased, whereby the bracket 8 can be protected against degradation of the durability due to application of such high load to the pump as experienced upon occurrence of vibration.

Many modifications and variations of the present invention are possible in the light of the above techniques. It is therefore to be understood that within the scope of the appended claims, the invention may be practiced otherwise than as specifically described.

What is claimed is:

1. A swash plate type axial piston pump, comprising:

a first housing section provided with an intake passage which can be connected to an external oil reservoir and a discharge passage capable of discharging a pressurized oil to an exterior device, said first housing section having one end opened;

a second hollow housing section connected at one end thereof to said open end of said first housing section;

a third housing section attached to other end of said second housing section;

a rotatable shaft disposed within a housing formed by said first housing sections, said second housing section and said third housing section and having one end rotatable supported in said first housing section by means of a first bearing and the other end rotatably supported in said third housing section by means of a second bearing;

a cylinder block disposed within said first housing section and said second housing section and mounted on said rotatable shaft slideably in an axial direction thereof and corotatably therewith, said cylinder block having a plurality of cylinders each defining therein a pump chamber;

a valve plate having one end surface bearing against an inner surface of said first housing section and an other end surface bearing slideably on a bottom surface of said cylinder block, said valve plate having an intake port and a discharge port for allowing said intake passage and said discharge passage formed in said first housing section to be selectively communicated to said pump chamber defined within each of said cylinders, said rotatable shaft rotatably extending through said valve plate;

an annular supporting member disposed within and mounted to an inner wall of said second housing section;

an annular shoe holder having a plurality of retaining holes and slideably held at an outer peripheral portion thereof by means of said supporting member;

a plurality of pistons each having one end portion slideably fit into each of said cylinders;

shoes pivotally coupled to other ends of said pistons, respectively, and retained by said retaining holes, respectively, of said annular shoe holder; and a swash plate installed within said second housing section and having an outer peripheral portion directly bearing against said annular supporting member in a state inclined relative to a center axis of said rotatable shaft, said swash plate being capable of slideably bearing against said shoes, wherein said rotatable shaft extends rotatably through said swash plate.

2. A swash plate type axial piston pump according to claim 1, further comprising an insulator disposed between said second housing section and said third housing section and having one lateral surface bearing against said swash plate for holding said swash plate at the outer peripheral portion thereof in cooperation with said annular supporting member, said rotatable shaft being rotatably inserted through said insulator.

3. A swash plate type axial piston pump according to claim 1, said annular supporting member including an annular recess formed in one end surface thereof and an annular offset portion formed at a position distanced from said annular recess in the axial direction, wherein the outer peripheral portion of said swash plate engages with said annular recess of said annular supporting member, while the outer peripheral portion of said annular shoe holder slideably bears against said annular offset portion of said annular supporting member, and wherein a resiliently urging member for urging said annular supporting member to bear on said swash plate is disposed within said second housing section at one side of said annular supporting member.

4. A swash plate type axial piston pump according to claim 1, further comprising a bracket attached to the other end of said third housing section for supporting rotatably by means of a bearing an input shaft coupled to said rotatable shaft through a magnetic coupling.

5. A swash plate type axial piston pump according to claim 4, further comprising a regulator provided in association with said second housing section for adjusting a discharge oil pressure within said discharge passage to be constant.

6. A swash plate type axial piston pump according to claim 5, further comprising a two-way valve provided in association with said second housing section for changing over flow paths for working oil discharged from said discharge passage.

* * * * *